US006481644B1

(12) United States Patent
Olsen

(10) Patent No.: US 6,481,644 B1
(45) Date of Patent: Nov. 19, 2002

(54) DEVICE BY SPRINKLER NOZZLE

(76) Inventor: Odd A. Olsen, Bokn N-5561 (NO)

( * ) Notice: Subject to any disclaimer, the term of this patent is extended or adjusted under 35 U.S.C. 154(b) by 0 days.

(21) Appl. No.: 09/763,812

(22) PCT Filed: Aug. 18, 1999

(86) PCT No.: PCT/NO99/00257

§ 371 (c)(1),
(2), (4) Date: Feb. 26, 2001

(87) PCT Pub. No.: WO00/12222

PCT Pub. Date: Mar. 9, 2000

(30) Foreign Application Priority Data

Aug. 26, 1998 (NO) ..... 19983910

(51) Int. Cl.[7] ..... B05B 1/32

(52) U.S. Cl. ..... 239/456; 239/204; 239/452; 239/500; 239/506; 239/524; 239/569; 169/37; 169/62

(58) Field of Search ..... 239/451, 456, 239/518, 524, 537, 539, 541, 569, 200, 201, 203, 204, 500, 506, 554, 521, 522, 523, 452, 453; 169/37, 62

(56) References Cited

U.S. PATENT DOCUMENTS 1,011,314 A * 12/1911 Canner ..... 239/541
1,625,042 A * 4/1927 McArdle ..... 239/500
2,325,280 A * 7/1943 Scherrer ..... 239/204
2,552,445 A 5/1951 Nielsen
3,102,691 A * 9/1963 Gall ..... 239/456
3,737,105 A 6/1973 Arnold et al.
4,653,693 A 3/1987 Steingass
5,119,991 A * 6/1992 Divers ..... 239/456
6,007,001 A * 12/1999 Hilton ..... 239/452

FOREIGN PATENT DOCUMENTS

NO 9410 11/1900
NO 302021 1/1998
NO 981510 4/1998

* cited by examiner

*Primary Examiner*—Steven J. Ganey
(74) *Attorney, Agent, or Firm*—Andrus, Sceales, Starke & Sawall, LLP

(57) ABSTRACT

The invention relates to a device by sprinkler nozzle (1) for use in a sprinkler system. The sprinkler nozzle (1) comprises a sprinkler nozzle housing (2) with a passage (3) therethrough for liquid, and a sprinkler nozzle pin (4, 5) which is disposed in the passage (3) of the sprinkler nozzle housing (2). The purpose of the invention is to provide a sprinkler nozzle which spreads the liquid by a sufficient distance from the outlet of the sprinkler nozzle (1) both in a horizontal and in a vertical direction. This is realized by the sprinkler nozzle pin being constituted by an inner sprinkler nozzle pin part (4) which is fixed to the sprinkler nozzle housing (2), and an outer sprinkler nozzle pin part (5) which is displaceably arranged in the sprinkler nozzle housing (2). Further, the sprinkler nozzle pin parts (4, 5) are arranged coaxially to the passage (3) of the sprinkler nozzle housing (2).

12 Claims, 3 Drawing Sheets

DEVICE BY SPRINKLER NOZZLE

CROSS REFERENCE TO RELATED APPLICATION

The present application is the U.S. national stage application of International Application PCT/NO99/00257, filed Aug. 18, 1999, which international application was published on Mar. 9, 2000 under PCT Article 21(2) as International Publication WO 00/12222 in the English language. The International Application claims the priority of Norwegian Patent Application 19983910, filed Aug. 26, 1998.

BACKGROUND OF THE INVENTION

The present invention relates to a device by sprinkler nozzle, intended for use in a sprinkler system. In usual manner the sprinkler nozzle comprises a sprinkler nozzle housing with a passage therethrough for liquid, and a sprinkler nozzle pin arranged in the passage in the sprinkler nozzle housing. The sprinkler nozzle is activated to sprinkle liquid by displacement of the sprinkler nozzle pin to a position in which the passage in the sprinkler nozzle housing is opened.

The helicopter traffic in connection with the production of petroleum off shore has given rise to strict requirements to the fire fighting systems disposed on the helipads of the installations. Besides, it is expected that the requirements will be tightened, with, among other things, specifications that a possible fire shall be extinguished within a very short time, while at the same time the temperature at the fire area is to be kept down. Likewise, that the fire extinguishing liquid shall be spread in the specified manner independent of the intensity of the fire and the prevailing weather conditions. Known fire fighting systems may consist of a number of deluge guns disposed around the helipad, sprinkler system mounted into the helipad, or as a combination of both deluge guns and sprinkler system.

Practice has shown that known systems for fire fighting, that be deluge guns or sprinkler systems, are absolutely not unproblematic in use. Tightened requirements to the fire fighting system will worsen the situation further. As for the deluge guns, it may be mentioned as a defect that they are difficult to operate manually, because of high temperature close to the fire, the extinguishing liquid from the guns undesirably flushes other parts of the installation with burning petrol, the wind carries the extinguishing liquid away from the fire area, or that such guns hardly permit automatic operation in a fully satisfactory manner. As to sprinkler plants, it may be mentioned as a defect that known sprinkler nozzles are not capable of spreading the fire extinguishing liquid in such amounts that the fire is extinguished quickly enough, of keeping the temperature by the fire low enough, or of spreading the liquid to a sufficient height from and to the sides of the outlet of the sprinkler nozzle.

SUMMARY OF THE INVENTION

The main object of the present invention is to provide a device by a sprinkler nozzle which is of sufficiently large capacity for the sprinkler plant to be able to extinguish a possible fire within a very short period of time, while at the same time the temperature in the fire area is to be kept down. A further object is that the fire extinguishing liquid is to be sprayed up to a minimum height above, and to a minimum lateral distance from the outlet of the sprinkler nozzle. This is realised by means of the present device by sprinkler nozzle, in which the particularity is that the pin of the sprinkler nozzle is constituted by an inner sprinkler nozzle pin part which is fixed to the sprinkler nozzle housing, and an outer sprinkler nozzle pin part which is displaceably arranged in the sprinkler nozzle housing. Furthermore, the sprinkler nozzle pin parts are arranged coaxially in the passage in the sprinkler nozzle housing, so that the outer sprinkler pin part surrounds the inner sprinkler nozzle pin part. Thereby are provided sprinkler nozzles enabling the formation of sprinkler systems with a capacity of meeting the new and tightened requirements to fire protection of e.g. helipads. Likewise, the invention could eliminate the use of deluge guns. Other advantageous features of the invention appear from the claims and of the specification.

BRIEF DESCRIPTION OF THE SEVERAL VIEWS OF THE DRAWING

In the following part of the specification, and with reference to the accompanying set of figures, preferred embodiments of the invention will be explained in further detail, in which.

DETAILED DESCRIPTION OF THE INVENTION

Figure 1:
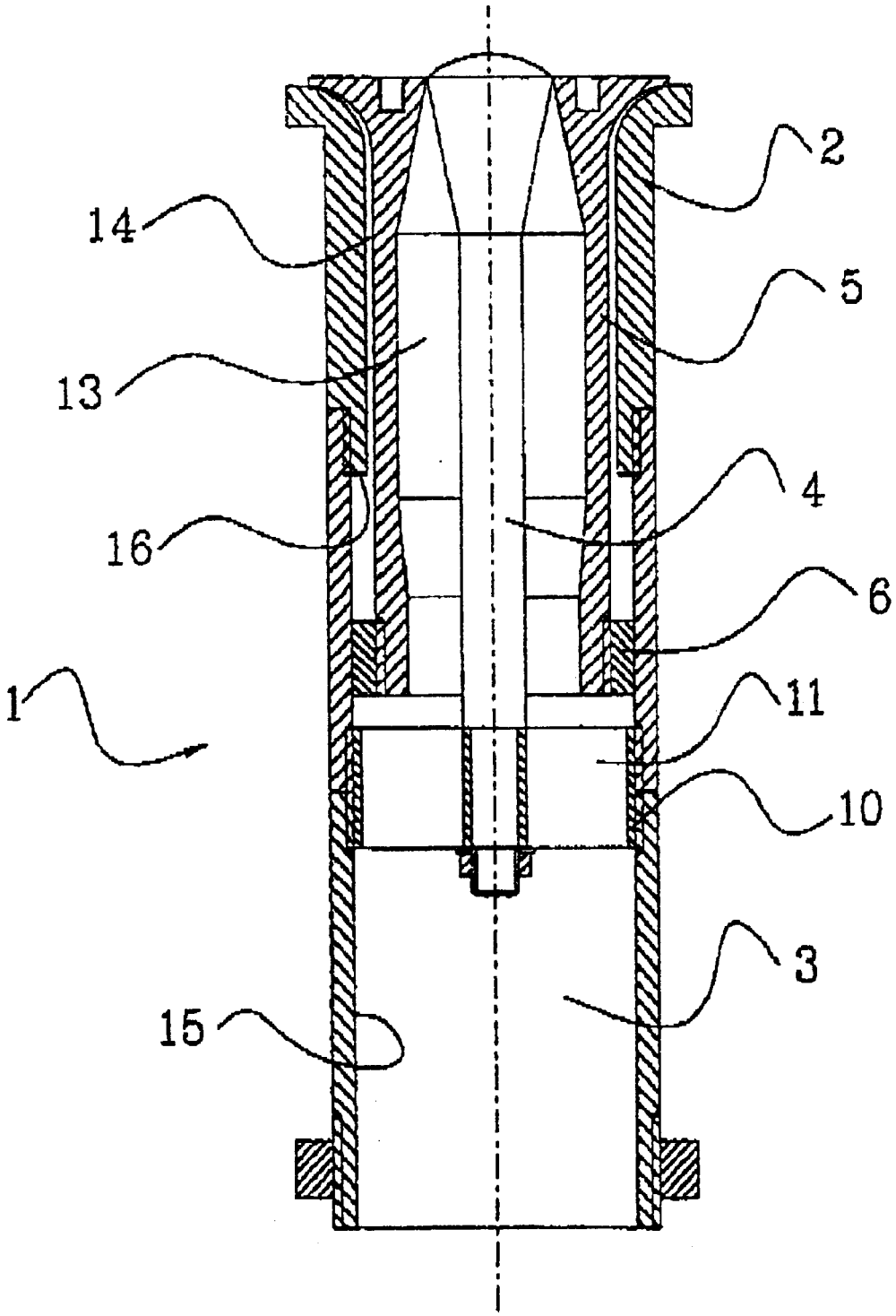
FIG. 1 shows a schematic view of a vertical section through the present sprinkler nozzle in stand-by position.
Figure 2:
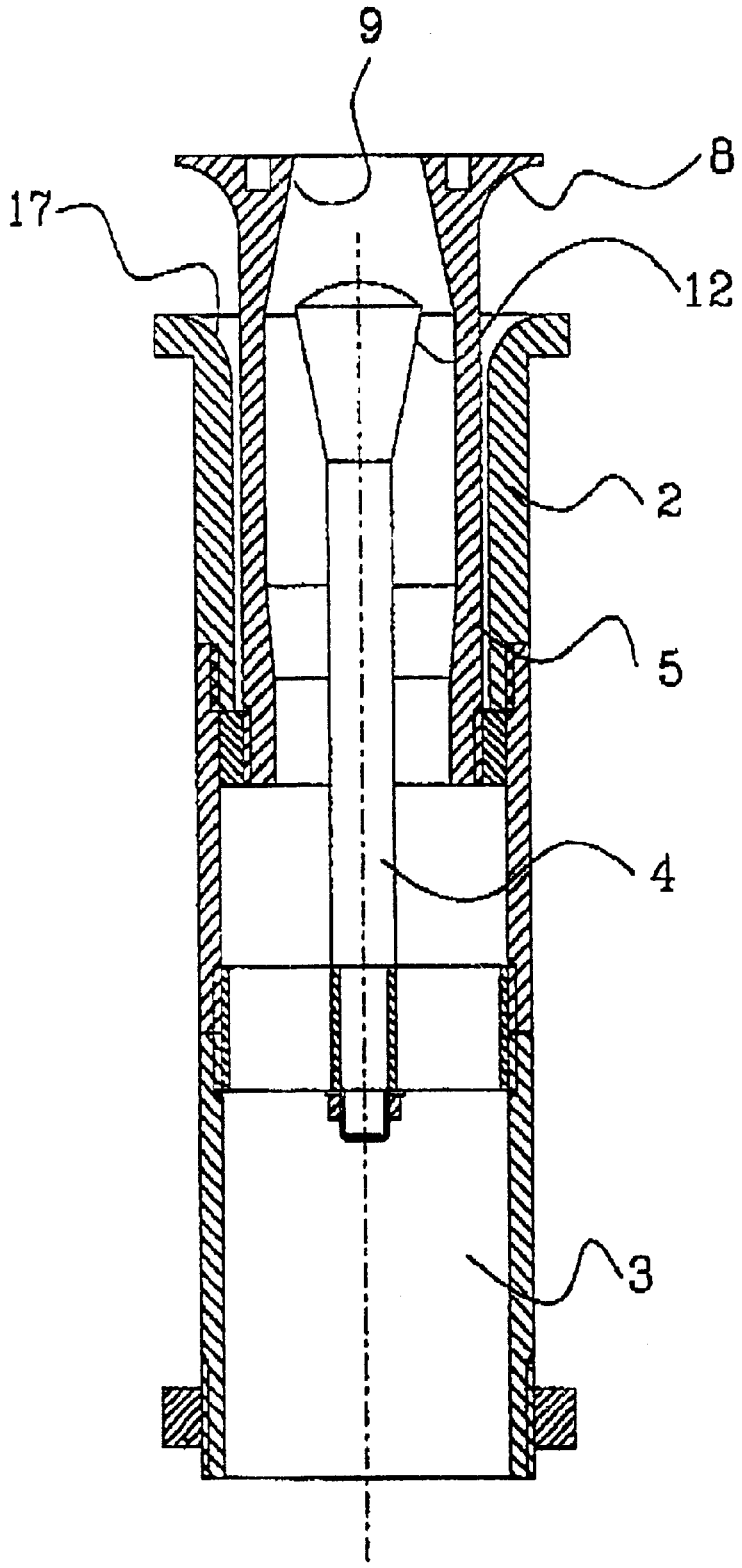
FIG. 2 shows the same as FIG. 1, apart from the sprinkler nozzle being in an activated position.
Figure 3:
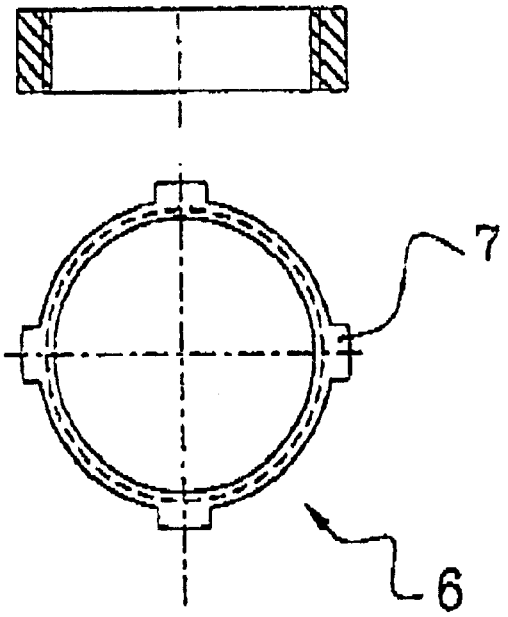
FIG. 3 shows a schematic view of sections through the flange of the outer sprinkler nozzle pin part.
Figure 4:
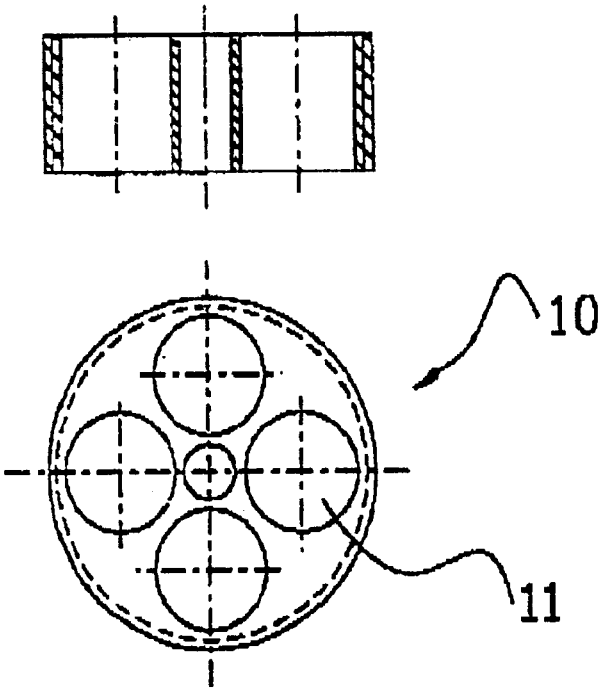
FIG. 4 shows a schematic view of sections through the securing part of the inner sprinkler nozzle pin part.

The sprinkler nozzle 1 which is shown in the set of figures, consists of a sprinkler nozzle housing 2 with a passage 3 for liquid. The sprinkler nozzle 1 shown is made up of three housing elements which may be connected to each other by means of threaded connections formed in the appropriate end of the respective housing element. A lower housing element is formed with an external lock nut and with a length adjusted to e.g. the deck profile of a helipad comprising a sprinkler system for fire fighting. A lower end of each sprinkler nozzle is connected to a respective pipe end of the piping of the sprinkler system for the supply of suitable liquid such as water, water with a foam concentrate (AFFF), etc. It is a matter of course that the sprinkler housing 2 may be formed in another manner than by the use of the three sprinkler housing elements shown.

The sprinkler nozzle pin of the sprinkler nozzle 1 providing actuation and sprinkling of the liquid supplied in the sprinkler system, is disposed in the passage 3 in the sprinkler nozzle housing 2 and is constituted by an inner sprinkler nozzle pin part 4 which is fixed to the sprinkler nozzle housing 2, and an outer sprinkler nozzle pin part 5 which is displaceably arranged in the sprinkler nozzle housing 2. The sprinkler nozzle pin parts 4, 5 are arranged coaxially in the passage 3 in the sprinkler nozzle housing 2, and in such a way that the displaceable outer sprinkler pin part 5 surrounds the fixed inner sprinkler nozzle pin part 4. The upper end of the inner sprinkler nozzle pin part 4 is at the level of the upper end of the sprinkler nozzle housing 2. The upper end of the outer sprinkler nozzle pin part is correspondingly at the level of the upper end of the sprinkler nozzle housing 2 when the sprinkler nozzle is in its non-activated position. In the activated position the outer sprinkler nozzle pin part 5 is displaced preferably by 15 mm upwards from the upper end of the upper end of the sprinkler nozzle housing 2. The upper ends of the sprinkler nozzle pin parts have shapes that are adapted, among other things, to close the passage 3 when the sprinkler nozzle 1 is in its non-activated position.

To ensure that the outer sprinkler nozzle pin part may be displaced expediently in the passage 3 in the sprinkler nozzle housing 2, the lower part of the outer sprinkler nozzle pin part 5 is formed with a flange 6 facing, and adapted to bear against, the side wall 15 of the passage 3 of the sprinkler nozzle housing 2. Further, the flange 6 has at least two beads 7 bearing against the side wall 15 of the sprinkler nozzle housing 2, so that the flange 6 will not block the passage 3. The passage 3 of the sprinkler nozzle housing 2 is formed with a shoulder 16 arranged above the flange 6. The shoulder 16 constitutes an abutment for the flange 6 when the sprinkler nozzle 1 is activated, so that the outer sprinkler nozzle pin part 5 is displaced in the sprinkler nozzle housing 2. The inner sprinkler nozzle pin part 4 is fixed to the sprinkler nozzle housing 2 by means of a securing element 10 extending between the side wall 15 of the passage 3 in the sprinkler nozzle housing 2 and preferably the lower end of the inner sprinkler nozzle pin part 4. The securing element 10 may be secured to the side wall 15 of the sprinkler nozzle housing 2 by means of a threaded connection. Said threaded connection may be formed in the respective end of the two lower housing elements. To prevent blocking of the passage 3, the securing element 10 has at least one bore 11.

The sprinkler nozzle 1 intentionally achieves the horizontal and vertical spreading of the liquid supplied, by means of deflecting faces 8, 9, 12 which are formed at the upper ends the sprinkler nozzle pin parts 4, 5. The deflecting faces 8, 9 of the outer sprinkler nozzle pin part 5 are at an outward or inward angle from/towards the inner sprinkler nozzle pin part 4, as the deflecting face 8, sloping outwards from the inner sprinkler nozzle pin part 4, preferably extends in a curved line, and the deflecting face 9, sloping inwards towards the inner sprinkler nozzle pin part 4, preferably extends in a straight line, while the deflecting face 12 of the inner sprinkler nozzle pin part 4 is sloping outwards towards the outer sprinkler nozzle pin part 5, the deflecting face 12 preferably extending in a straight line. The upper end of the sprinkler nozzle housing 2 is formed with a deflecting face 17 sloping outwards from the sprinkler nozzle pin parts 4, 5, the deflecting face 17 preferably extending in a curved line. The deflecting face 17 works partly as a bearing and sealing surface for the deflecting face 8 of the outer sprinkler nozzle pin part 5, and partly to increase further the effect of the sprinkling of liquid. It is a matter of course that the deflecting faces 8, 9, 12, 17 may have an extent deviating from what is shown in the set of figures, so that the liquid may be directed in a way adjusted to the relevant application of the sprinkler nozzle.

Further, the sprinkler nozzle pin parts 4, 5 are of such form that the respective portions of the sprinkler nozzle pin parts 4, 5 below the deflecting faces 8, 9, 12 form channels 13, 14 for liquid in the passage 3 of the sprinkler nozzle housing 2. The channel 13 is formed between the lower portions of the sprinkler nozzle pin parts 4, 5, and the channel 14 between the lower part of the outer sprinkler nozzle pin part 5 and the side wall 15 of the passage 3 in the sprinkler nozzle housing 2.

The present sprinkler nozzle is activated in the way that the liquid, which is supplied to the sprinkler nozzle, passes through the bores 11 of the securing element 10 of the inner sprinkler nozzle pin part 4, and presses against the lower face of the flange 6 and the end surface of the outer sprinkler nozzle pin part 5, so that the outer sprinkler nozzle pin part 5 is displaced upwards until the upper face of the flange 6 abuts the shoulder 16 of the passage 3 in the sprinkler nozzle housing 2. Thereby the outer sprinkler nozzle pin part 5 is brought into a position allowing the liquid to pass freely in the passage 3 through the bore 11, the openings in the flange 6 created by the beads 7, the channels 14, 15 and to be deflected by the deflecting faces 8, 9, 12, 17 at the upper end of the sprinkler nozzle.

In the above is specified, for reasons of simplicity, that the sprinkler nozzle is integrated in a sprinkler system disposed in helipads. Since the present sprinkler nozzle may be used in any sprinkler system, the above reference to the helipad must only be understood as an illustrating example, Further, with a water pressure of 7 bars, the sprinkler nozzle could spread the liquid horizontally at least 6, 5 m radially outwards from, and to a height reaching 7 m from the outlet of the sprinkler nozzle. The so-called horizontal water volume is then at least 140 l/min, and the vertical water volume at least 200 l/min. Even by a wind force up to moderate gale the sprinkler nozzle could reach a height of at least 6 m. It is to be noted here that vertically the water volume may be regulated by adjusting the point of location of the flange 6 of the outer sprinkler nozzle pin part 5, and thus the lifting height of the outer sprinkler nozzle pin part 5, which affects the volume of the flow through the channel 13 between the sprinkler nozzle pin parts 4, 5.

What is claimed is:

1. A sprinkler nozzle (1) for use in a sprinkler system, comprising:

a sprinkler nozzle housing (2) with a passage (3) therethrough for liquid, and a sprinkler nozzle pin assembly (4, 5) arranged coaxially in the passage (3) of the sprinkler nozzle housing (2), wherein, the sprinkler nozzle pin assembly comprises an inner sprinkler nozzle pin part (4) fixed to the sprinkler nozzle housing (2), and an outer sprinkler nozzle pin part (5) surrounding said inner sprinkler nozzle pin part and displaceably arranged in the sprinkler nozzle housing (2);

said inner sprinkler nozzle pin part (4) having a discharge end formed with a first deflecting face (12) for liquid, said first deflecting face (12) sloping outwardly toward the outer sprinkler nozzle pin part (5) in a direction of liquid flow through said passage;

said outer sprinkler pin part (5) having a discharge end formed with a second, exterior deflecting face (8) and a third, interior deflecting face (9), said second deflecting face (8) sloping outwardly toward said sprinkler nozzle housing (2) in the liquid flow direction, and said third deflecting face sloping inwardly toward the inner sprinkler nozzle pin part (4) in the liquid flow direction.

2. A device according to claim 1 wherein the second deflecting face (8) extends in a curved line, and the third deflecting face (9) extends in a straight line.

3. A device according to claim 1 wherein the first deflecting face (12) extends in a straight line.

4. A device according to claim 1 wherein a discharge end of the sprinkler nozzle housing (2) is formed with a fourth deflecting face (17) forming an abutment and sealing surface for the second deflecting face (8) in a non-activated position of said outer sprinkler nozzle pin part (5), the fourth deflecting face (17) sloping outwardly from the sprinkler nozzle pin parts (4, 5) in the liquid flow direction.

5. A device according to claim 4 wherein the fourth deflecting face (17) extends in a curved line.

6. A device according to claim 1 wherein an end of the outer displaceable sprinkler nozzle pin part (5) opposite said discharge end is formed with a flange (6) facing inwards and arranged to bear against a side wall (15) of the passage (3) of the sprinkler nozzle housing (2).

7. A device according to claim 6 wherein the flange (6) is formed with at least two beads (7) bearing against the side wall (15), so that the flange (6) does not block the passage (3) in the sprinkler nozzle housing (2).

8. A device according to claim 6 wherein the passage (3) of the sprinkler nozzle housing (2) is formed with a shoulder (16) forming an abutment for the flange (6) on the outer sprinkler nozzle pin part (5).

9. A device according to claim 1 wherein the inner sprinkler nozzle pin part (4) is fixed to the sprinkler nozzle housing (2) by means of a securing element (10) extending between a side wall (15) of the passage (3) of the sprinkler nozzle housing (2) and an end of the inner sprinkler nozzle pin part (4) opposite said discharge end.

10. A device according to claim 9 wherein the securing element (10) is formed with at least one bore (11), so that the securing element (10) does not block the passage (3) of the sprinkler nozzle housing (2).

11. A device according to claim 1 wherein the sprinkler nozzle pin parts (4, 5) are so adapted, that the respective portion of the sprinkler nozzle pin parts (4, 5) below the first, second, and third deflecting faces (8, 9, 12) form first and second channels (13, 14) for liquid in the passage (3) of the sprinkler nozzle housing (2).

12. A device according to claim 11 wherein the first channel (13) for liquid is formed between said inner sprinkler nozzle pin part (4) and said outer sprinkler nozzle pin part (5) and the second channel (14) is formed between said outer sprinkler nozzle pin part (5) and said housing (2).

* * * * *